United States Patent [19]

Odenthal

[11] Patent Number: 4,982,552

[45] Date of Patent: Jan. 8, 1991

[54] APPARATUS FOR THE PACKAGING OF PAPER STACKS

[75] Inventor: Heinz F. Odenthal, Zülpich, Fed. Rep. of Germany

[73] Assignee: Ostma Maschinenbau GmbH, Zulpich, Fed. Rep. of Germany

[21] Appl. No.: 479,064

[22] Filed: Feb. 12, 1990

[30] Foreign Application Priority Data

Mar. 14, 1989 [DE] Fed. Rep. of Germany ..... 3908184

[51] Int. Cl.[5] ..... B65B 11/04

[52] U.S. Cl. ..... 53/207; 53/580; 493/479

[58] Field of Search ..... 53/201, 207, 222, 223, 53/580; 493/478, 479

[56] References Cited

U.S. PATENT DOCUMENTS

| | | | |
|---|---|---|---|
| 3,242,635 | 3/1966 | Kobick | 53/222 |
| 3,665,675 | 5/1972 | Johnson | 53/223 |
| 3,782,071 | 1/1974 | Hagedorn | 53/207 X |
| 3,834,114 | 9/1974 | Johnson | 53/223 X |

*Primary Examiner*—John Sipos

*Attorney, Agent, or Firm*—Herbert Dubno

[57] ABSTRACT

An apparatus for packaging stacks of paper has a suction plunger assembly which can be lowered to draw a box blank and a stack of paper thereon downwardly past the box folding element of a box folding claim of guide rods which are connected to the guide rods of the suction plunger assembly so that, upon adjustment of the format of the box folding assembly, the positions of the suction plunger will be automatically adjusted.

9 Claims, 4 Drawing Sheets

APPARATUS FOR THE PACKAGING OF PAPER STACKS

FIELD OF THE INVENTION

My present invention relates to an apparatus for the packaging of stacks of paper, e.g. reams of paper. More particularly, the invention relates to the boxing of a ream or other stack of paper.

BACKGROUND OF THE INVENTION

It is known to provide an apparatus for the automatic or semiautomatic packaging of paper stacks in which a packaging or box blank is folded into the shape of a box and formed around a ream or other stack of paper deposited on that blank. The apparatus generally comprises a box-folding assembly associated with a suction plunger assembly providing a receiving plane for the blank. As the suction plunger assembly is lowered, the box folding assembly is effective to fold the blank into a box shape around the paper stack which is deposited on the blank, e.g. by folding the sides of the blank into an upright configuration about the paper stack.

The apparatus must be capable of accommodating different formats or sizes of the paper stack and the packaging blank.

With prior art apparatuses of this type, the structurally separate box folding assembly and suction plunger assembly must be adjusted separately and hence the setting of the apparatus to a particular format or the change of format of the assembly is complex, requires a number of manipulative procedures and positioning operations and, in particular, mandates separate adjustment or resetting of the box folding unit and the suction plunger unit.

OBJECTS OF THE INVENTION

It is, therefore, the principal object of the present invention to provide an apparatus for the purposes described in which the adjustment of the box folding assembly and the suction plunger assembly to different formats can be achieved simply and with a minimum of operational steps.

Another object of this invention is to provide an apparatus for the packaging of paper stacks and specifically for the boxing of reams of paper and like stacks, whereby the drawbacks of prior art systems are avoided.

SUMMARY OF THE INVENTION

These objects and others which will become apparent hereinafter are obtained, in accordance with the present invention by providing a box-folding assembly and a suction plunger assembly of the apparatus which are integrated with one another for adjustment to different formats. In particular, the box folding assembly comprises a plurality of box-folding guide rods which close orthogonally to one another at corners of the box folding assembly and which are adjustable with the aid of a setting drive so that, for example, opposite guide rods can be moved toward and away from on another to reset the box folding assembly to the format of a given blank. The guide rods carry sliders which move along the guide rods and can be provided with the box folding tools or elements which actually cause erection of the sides of the box. According to the invention, the suction plunger assembly comprises plunger guide rods which are parallel to the guide rods of the box folding assembly and on which the suction plungers are mounted via holders. The suction plunger guide rods are mechanically connected to the box folder guide rods and are adjustable in common therewith by the adjustment of the positions of the box folder guide rods.

As a consequence, the adjustment of the box folding assembly to a given given box format will simultaneously adjust the positions of the suction plungers of the plunger assembly appropriately to this new format.

According to another feature of the invention, the guide rods of two opposite sides of the box folding assembly are mounted in fixed end pieces and can include threaded spindle displacing at least one guide slide piece carrying the guide rods for the two other sides of the frame formed by the box folding assembly. In other words the guide rods of the first two sides of the frame are fixed in position with respect to one another while the guide rods of the other two sides can be moved relatively by the threaded spindles which may be driven by stepping motors, of the box folding frame. The box folding elements or tools, causing erection by the sides of the box clank are mounted, in turn, on slides carried by the guide rod of the two relatively movable sides of the box folding frame so that the format of the blank can be set.

These latter sliders, in turn, engage holders which can displace the guide rods of the plunger assembly and thus set the plunger assembly array of suction plungers to correspond to the new format determined by the positions of the sliders of the box folding assembly.

The suction plungers themselves may be mounted on the holders which are connected to the slide blocks of the box folding assembly and/or maybe mounted upon members which are independently supported on the guide rods of the plunger assembly and which therefore shifted in position as the guide rods of the plunger assembly are supplied or contracted during a format change of the box folding apparatus. In the latter case, a holder for one or more suction plungers may be located at the intersection of two orthogonal guide rods of the plunger assembly.

The holders affixed to the slide blocks of the box folding assembly may be mounted thereon so as to be vertically displaceable to effect raising and lowering of the entire array of guide rods of the suction plunger assembly and thus of the suction plungers mounted thereon.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
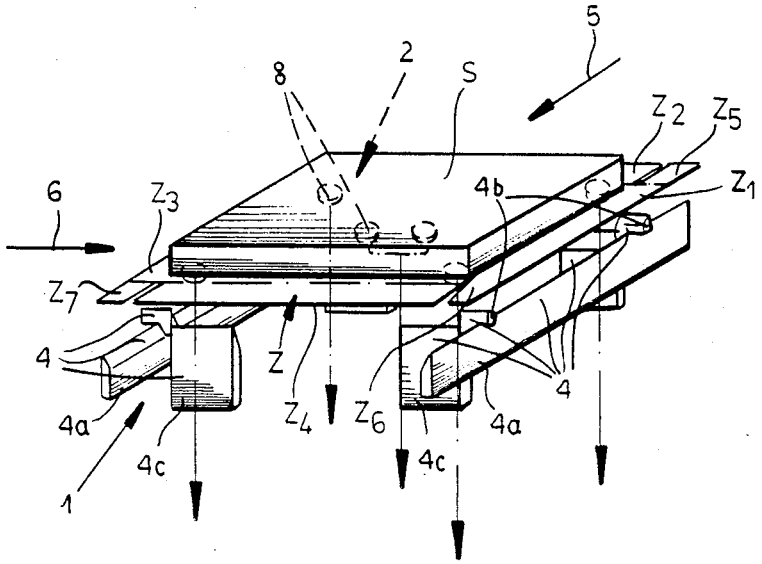
FIG. 1 is a diagrammatic perspective view of an apparatus for packing paper stacks and having a box folding assembly and a suction plunger assembly, according to the invention, in a first functional position.

The apparatus illustrated in the drawing is used for the packaging of a paper stack. In general, the apparatus comprises a box folding assembly 1 and, integrated therewith so as to be adjustable therewith to different box and paper formats, a suction plunger assembly 2. These parts of the apparatus are illustrated most generally in FIGS. 1 and 2. The guide rod arrangements, holders, sliders and box folding elements or tools are shown in greater detail in FIGS. 3 and 5. In the various Figures, all of the degrees of movement of the devices have been illustrated by single headed arrows or double headed arrows.

Figure 2:
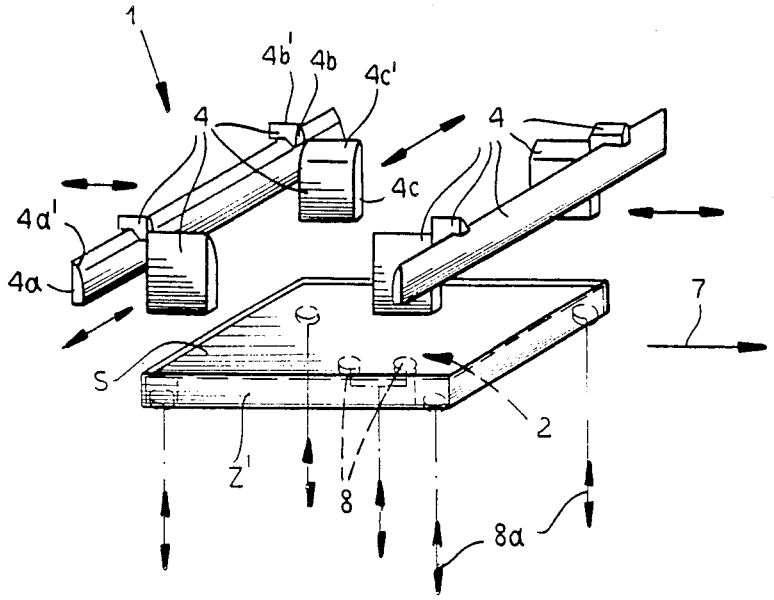
FIG. 2 is a view similar to FIG. 1 showing the apparatus in a second operative position.

As can be seen from FIGS. 1 and 2, the box folding assembly 1 defines a receiving plane (plane of its upper edges) for a packaging blank, in this case, a box blank Z. As is apparent from FIG. 1, the box blank Z has sides $Z_1$, $Z_2$, $Z_3$ and $Z_4$ which can be bent upwardly to form half of a box around a ream or stack of paper S. The side walls $Z_1$ to $Z_4$ are formed with tabs $Z_5$, $Z_6$ and $Z_7$, etc. which can be turned inwardly upon folding to be glued by means not shown to the inner faces of adjoining erected walls when the box is erected (compare FIGS. 1 and 2).

The folding into erect positions of side walls $Z_1$ to $Z_4$ and, if desired, the inward folding of the tabs $Z_5$ to $Z_7$ can be effected by folding elements or tools generally represented at 4. These elements can include longitudinally extending bars 4*a* which can serve to bend upwardly the sides $Z_1$ and $Z_3$, wedge shape formations 4*b* which can serve to bend inwardly the tabs $Z_5$ to $Z_7$ etc. at the ends of the sides $Z_1$ to $Z_3$ and which lie above the bars 4*a*.

The bending elements, in addition, can include bending members 4*c* which extend perpendicular to the bars 4*a* and define the corners of the box therewith. These bending members 4*c* serving to bend upwardly the sides $Z_2$ to $Z_4$, respectively, if the box blank is lowered past these tools or elements by the suction plunger example described in greater detail below.

As is clear from FIG. 2, each bar 4*a* can have a bevelled surface 4*a*', each element 4*a* can have a bevelled surface 4*b*' and each of the members 4*c* can have a bevelled surface 4*c*' facilitating the folding of the sides and tabs of the box into the half box shape illustrated at Z' in FIG. 2.

The blank Z is fitted to the apparatus in the direction of the arrow S by any conventional manipulator, e.g. a suction transfer device (not shown). The paper stack S or ream is fed in the direction of the arrow 6 by a conventional stack feeding device or the stack feeder described and illustrated in the commonly assigned copending application Ser. No. 07/462,419 filed Jan. 9, 1990 and the boxed ream or stack is removed in the direction of the arrow 7 by conventional means (not shown) for receiving the box cover or lid. The half box containing the stack of paper rests upon the suction plungers 8 until it is removed in the direction of arrow 7 and is retained by the suction of these plungers until the package is to be released, whereupon the suction can be cut off.

The suction plunger assembly comprises a plurality of suction plungers 8 which are simultaneously raised and lowered as represented by the double headed arrows 8*a* in FIG. 2. The heads of the suction plungers 8 can form or lie in the receiving plane in their raised positions (FIG. 1). Once the paper stack S has been deposited on the blank Z, the entire suction plunger assembly 2 with the plunger 8 is lowered through the array of tools or folding elements 4 to effect the erection of the half box shown at Z' in FIG. 2 and as a comparison of FIGS. 1 and 2 are illustrated. After the boxed paper stack has been removed in the direction of arrow 7, the suction plungers 8 are raised again to the original position shown in FIG. 1 to receive a new blank 2 and a new ream S of paper.

Figure 3:
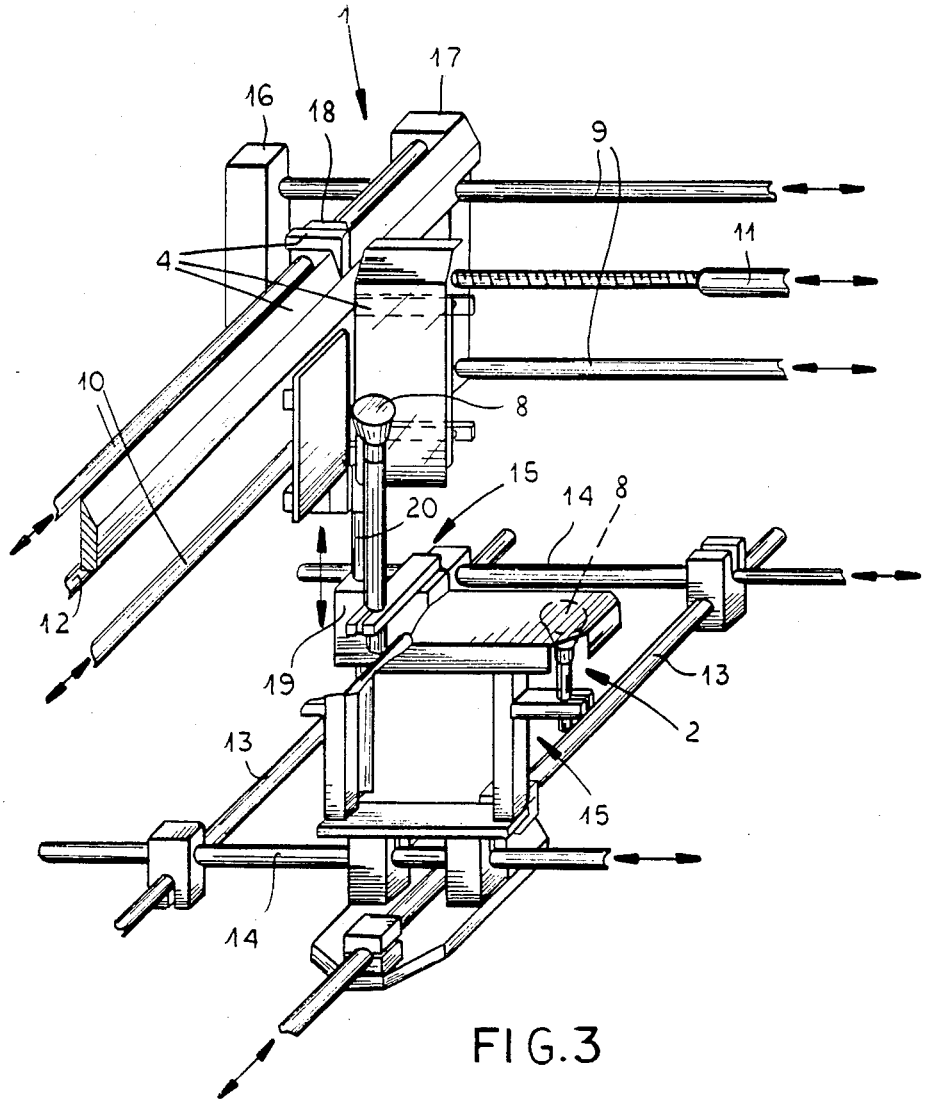
FIG. 3 is a fragmentary perspective view showing the upper lefthand corner of the apparatus in greater structural detail and do not to an enlarged scale by comparison with the earlier figures.
Figure 4:
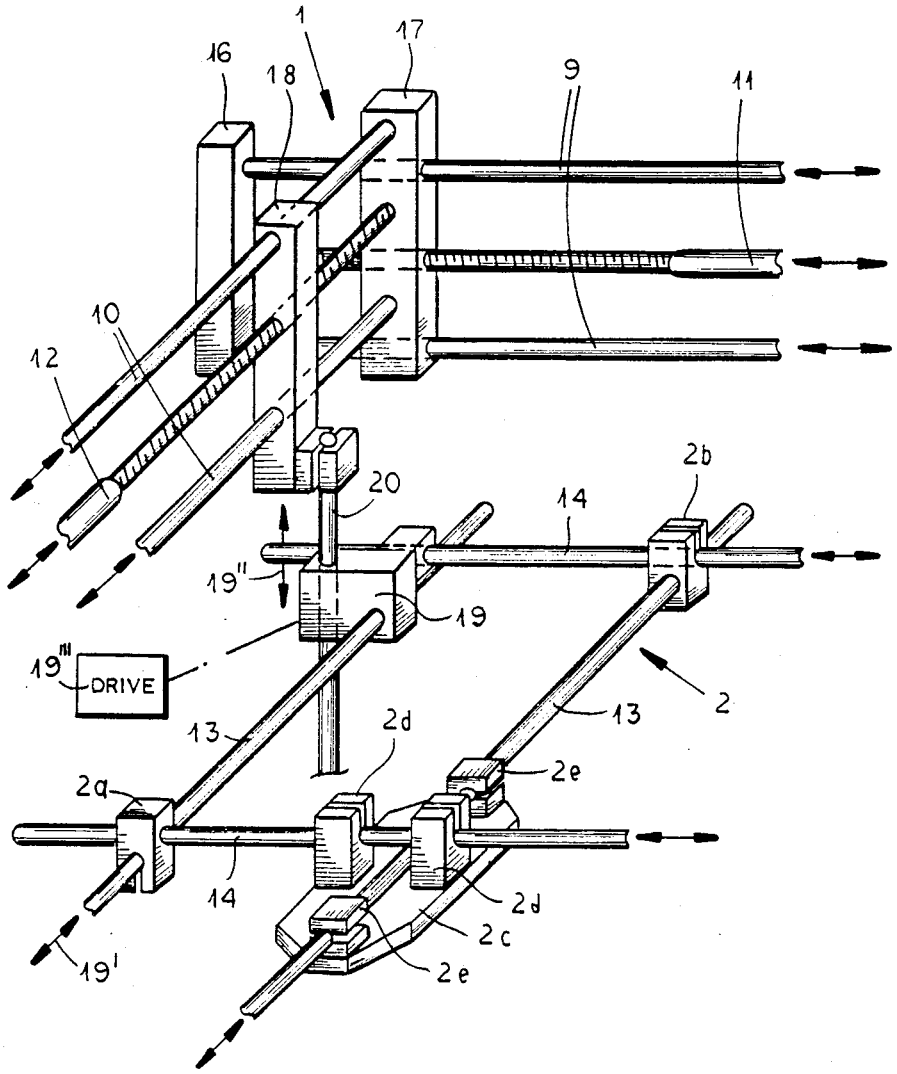
FIG. 4 is a view similar to FIG. 3 showing the same part of the apparatus with the plungers and box folding elements or tools removed to illustrate the guide rod system in greater detail.
Figure 5:
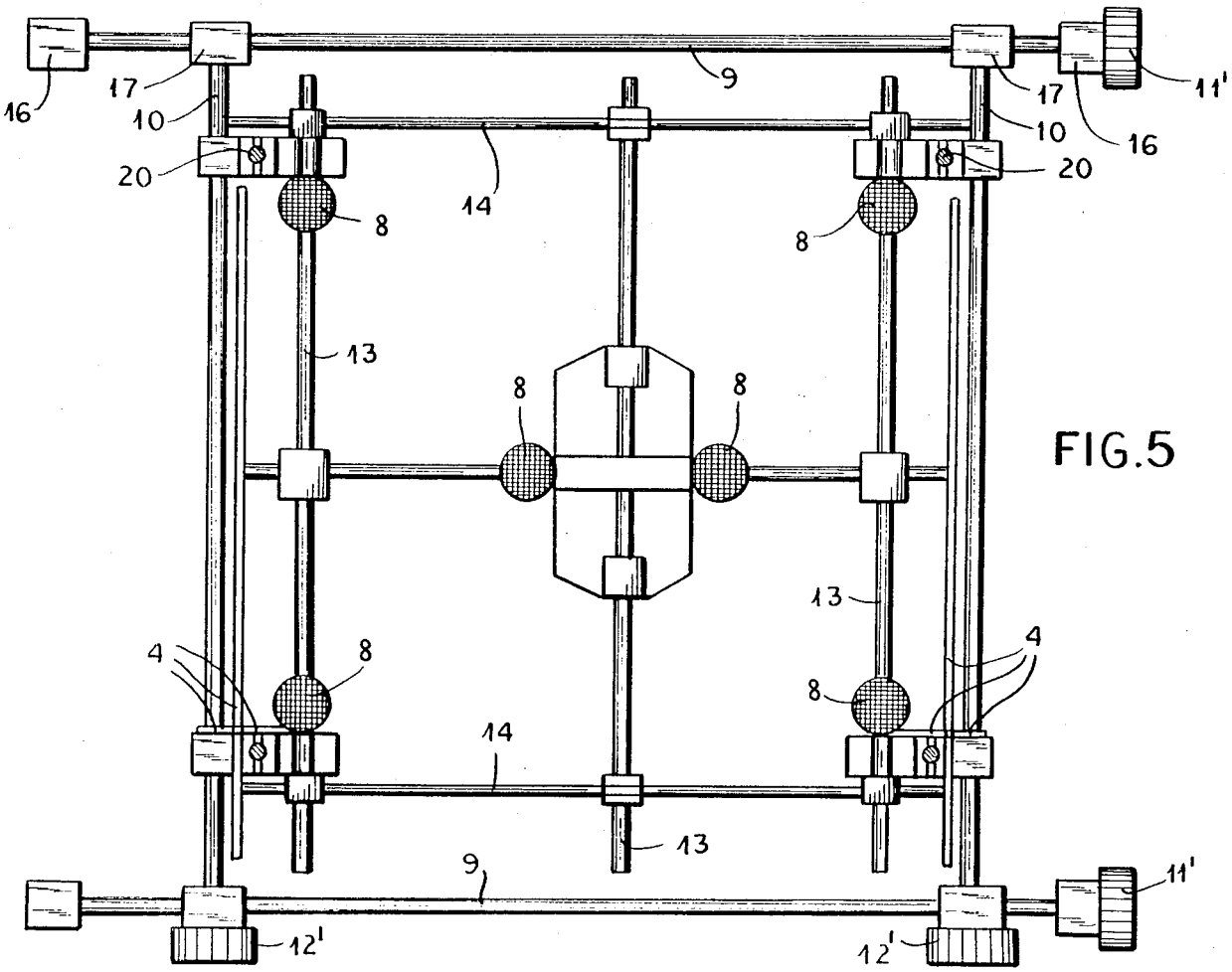
FIG. 5 is a plan view of the apparatus.

Referring now to FIGS. 3 to 5, it will be apparent that the folding apparatus comprises a plurality of folder guide rods 9 and 10 which cross orthogonally to one another at the corners. The adjustment of the positions of the guide rods can be effected by setting motors 11' for the threaded spindles 11 associated with the guide rods 9 (see FIG. 5) and stepping motors 12' driving the threaded spindles 12 associated with the guide rod 10. It can be seen from FIGS. 3 and 4 especially that the suction plunger assembly 2 comprises guide rods 13 and 14 which are parallel to the guide rods 9 and 10 and on which the suction plungers 8 are mounted by holds 15 which can be shiftable to shift the suction plungers 8 for format setting. The guide rods 13 and 14 are, in addition, mechanically coupled to the guide rods of the box folding apparatus as will be described in greater detail.

The guide rods of the box-folding assembly or frame comprise a first group of guide rods 9 which are fixed together at the corners of the frame in members 16 and extend along to opposite sides of the frame, i.e. the upper and lower sides as can be seen in FIG. 5

As is apparent from FIGS. 3 and 4, at least one of the guide rods of the first group on each side is formed as a drive rod, namely, a threaded spindle 11 driven by the respective stepping motor 11' (FIG. 5) and threadedly connected to a respective slider 17 to shift the guide rods 10 of the second group during a format change.

The guide rods 10 of the second group lie along the other sides of the frame constituting the box folding assembly and include a drive guide rod in the form of a threaded spindle 12 on each side, driven by the respective motor 12'. The spindles 12' threadedly engage holders 18 which carry the folding elements 4 previously described (see especially FIG. 3) and also constitute the coupling mechanically linking the guide rods of the suction plunger assembly with the guide rods of the box folding assembly.

The drives 11, 11' and 12, 12' shift the cylinder blocks 17 and the folding element holder blocks 18 for format setting in the manner described.

The guide rods 13 and 14 of the suction-plunger assembly are connected to respective coupling blocks 19 which slide along the guide rods 13 and entrain the guide rods 14 in the direction of the double headed arrow 19'. The connecting blocks 19 are connected to the holders 18 by respective coupling rods 20 so that the blocks 19 can be shiftable in the direction of arrow 19'' up and down. The drive for this purpose may be a screwthread on the rod 20 or a piston or other device represented generally as a drive 19'''.

The operation of the drive 19''', the entire suction plunger assembly can be raised and lowered in the manner described.

Coupling the guide rods 13 and 14 are sliders 2*a* and 2*b* located at closings of these guide rods as well as a central bracket 2c whose slide blocks 2d can receive a guide rod 14 and whose slide blocks 2e can receive a guide rod 13. Thus, as the slide block 19 shifts to follow the format change, the other rods will slide in the respective blocks to compress the layout of the plungers 8 or enlarge the layout correspondingly.

The suction plungers 8 are mounted, in turn, on brackets 15 secured to the slide blocks 19 and the holder 2c as illustrated in FIG. 3 so as to assume distributions as indicated in block lines in FIGS. 1 and 2 by wa of example.

Consequently, by comparison with earlier devices, in which the box folding assembly is separate from the suction plunger assembly and must be reset independently thereof for a format change, the apparatus of the invention has the advantage that the suction plunger assembly is automatically adjusted with each format change of the box folding assembly. Subsequent correction is not required. The two assemblies thus not only form a functionally integrated system but a structurally integrated arrangement and one which is integrated in the sense of the control technique.

I claim:

1. An apparatus for the packaging of a paper stack, comprising:

a box-folding assembly having a plurality of guide rods crossing orthogonally at corners of the box-folding assembly, and box-folding elements carried on at least some of said guide rods for folding a box blank drawn through said box-folding assembly into a box for receiving a stack of paper;

adjustment means connected with said guide rods of said box-folding assembly for shifting at least some of said guide rods of said box-folding assembly relative to others of said guide rods of said box-folding assembly to set a format of a box to be formed and a paper stack to be received therein;

a suction-plunger assembly having a plurality of guide rods extending parallel to said guide rods of said box-folding assembly, a plurality of suction plungers mounted on the guide rods of said suction-plunger assembly and adjustable therewith for different formats of boxes and stacks to be packaged, and means for raising said suction plungers to form a receiving plane for a box blank above said elements and lowering said suction plungers to lower said box blank and a paper stack disposed thereon past said elements, whereby said elements fold said box blank into a box around said stack disposed on said box blank; and means mechanically connecting said guide rods of said suction-plunger assembly with guide rods of said box-folding assembly for adjustment of the positions of said plungers simultaneously with adjustment of said guide rods of said box-folding assembly to a respective format of boxes and stacks to be packaged.

2. The apparatus defined in claim 1 wherein said guide rods of said box-folding assembly include a first group of guide rods disposed along two opposite sides of said box-folding assembly and fastened at corners of a frame of the apparatus, a second group of guide rods disposed along two other opposite sides of said box-folding assembly orthogonal to the rods of the first group, and sliders carrying said second group of guide rods shiftable along said guide rods of said first group, said adjustment means including at least one guide rod of said first group and shifting said sliders therealong, said elements being mounted on holders slidable along said guide rods of said second group by respective drives.

3. The apparatus defined in claim 2 wherein said suction plunger assembly is provided with a coupling block shiftable along at least one of the guide rods of said suction plunger assembly, said coupling block being connected to a respective one of said holders by a coupling rod and being shiftable up and down along said coupling rod relative to said box-folding assembly to raise or lower said suction plunger.

4. The apparatus defined in claim 3 wherein a suction plunger is mounted on said coupling block.

5. The apparatus defined in claim 4, further comprising a member connected to crossing guide rods of said suction plunger assembly and carrying at least one of said suction plungers.

6. The apparatus defined in claim 5 wherein said first group of guide rod includes a threaded spindle rotatable to displace said sliders along said guide rods of said first group.

7. The apparatus defined in claim 6, further comprising stepping motors driving said spindles.

8. The apparatus defined in claim 7 wherein the second ground of guide rods includes threaded spindles operatively connected to said holders to displace same.

9. The apparatus defined in claim 8, further comprising stepping motors connected to the spindles of said second group of guide rods.

* * * * *